United States Patent [19]

Noda et al.

[11] 3,934,969

[45] Jan. 27, 1976

[54] METHOD FOR BURNING EMULSION OILS

[75] Inventors: Hideyo Noda, Kyoto; Norio Kawai, Osaka; Osamu Tarue, Nagaokakyo; Kazuo Fukada, Takarazuka; Shigeyoshi Idehara, Akashi; Tadao Nakanishi, Osaka; Yuzo Kakimoto, Akashi; Yoshito Nakamura, Ibaraki, all of Japan

[73] Assignee: Kawasaki Jukogyo Kabushiki Kaisha, Kobe, Japan

[22] Filed: Dec. 20, 1974

[21] Appl. No.: 534,793

[30] Foreign Application Priority Data

Dec. 22, 1973 Japan ..... 48-3904

[52] U.S. Cl. ..... 431/9; 110/7 B; 431/115

[51] Int. Cl.[2] ..... F23J 5/02

[58] Field of Search ..... 431/2, 9, 115, 116; 110/7 B, 7 S

[56] References Cited

UNITED STATES PATENTS

| | | | |
|---|---|---|---|
| 3,734,035 | 5/1973 | Whitfield | 110/7 |
| 3,741,166 | 6/1973 | Bailey | 431/116 |
| 3,749,318 | 7/1973 | Cottell | 431/2 X |
| 3,781,162 | 12/1973 | Rudd et al. | 431/115 |

*Primary Examiner*—Kenneth W. Sprague
*Attorney, Agent, or Firm*—Armstrong, Nikaido & Wegner

[57] ABSTRACT

In burning an emulsion oil containing oil and water in a ratio of 5 – 9 : 5 – 1 by volume, a method characterized in that the emulsion oil is burned while recycling 10 to 40% by volume of the resulting combustion exhaust gas to a combustion chamber.

7 Claims, 2 Drawing Figures

METHOD FOR BURNING EMULSION OILS

Figure 1:
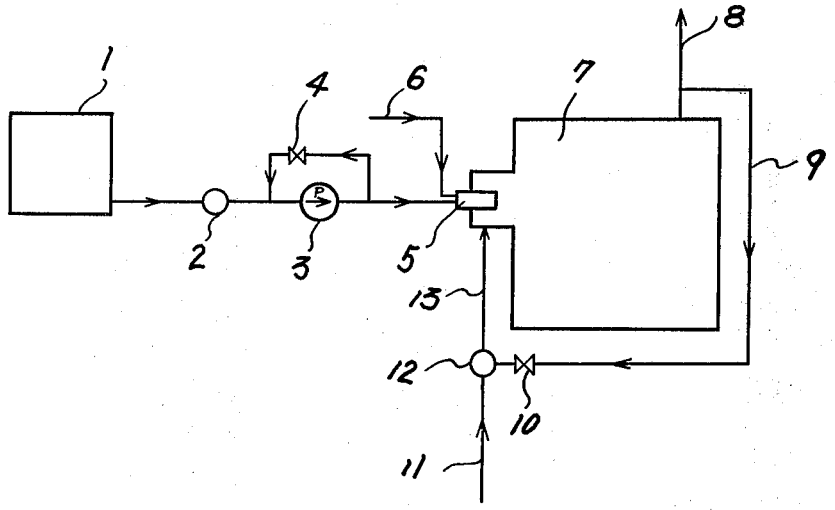

This invention relates to a method for burning oils, more particularly to an improved method for burning emulsion oils.

Researches have been made on methods for controlling or removing nitrogen oxide emissions from combustion of oil which are sources of air pollution such as photochemical smog.

Heretofore known as methods for controlling nitrogen oxide emissions are a combustion method using a reduced amount of air, exhaust gas recirculation method, two-stage combustion method and emulsion combustion method, etc.

However, these known methods are not fully effective in reducing nitrogen oxide emissions. For example, when a 6-ton boiler is operated at the rated steam output of 6 tons/hour (oxygen content of exhaust gas: 3 to 5% by volume), the amounts of resulting nitrogen oxides are: (1) 80 p.p.m. when kerosene is burned as it is, (2) 37 p.p.m. when kerosene is burned in the form of an emulsion containing 20% by volume of water, and (3) 40 p.p.m. when kerosene is burned with fresh air while recycling 20 to 30% by volume of exhaust gas. Thus the combustion of kerosene by an emulsion combustion method or exhaust gas recirculation method, when singly conducted, achieves merely about 50% reduction in the nitrogen oxide emissions as compared with burning of kerosene alone. On the other hand, the method using a reduced amount of air and the two-stage combustion method are also unable to reduce the nitrogen oxide emissions to less than 50% and further have the drawback of giving a large amount of soot during combustion.

With the ever increasing severity of the exhaust standards for nitrogen oxides in recent years, there is a great need to develop a method for controlling nitrogen oxides more effectively.

In order to satisfy this need, the present invention provides a method for burning oils which is capable of remarkably reducing nitrogen oxide emissions as compared with conventional methods without entailing formation of soot.

In burning an emulsion oil containing oil and water in a ratio of 5 – 9 : 5 – 1 by volume, the method for burning oil according to this invention is characterized in that the emulsion oil is burned while recycling 10 to 40% by volume of the resulting combustion exhaust gas to a combustion chamber.

Our researches have revealed that the emulsion combustion method and exhaust gas recirculation method, when practiced in combination, are capable of reducing nitrogen oxides to a much greater extent than is attainable when these method are each practiced independently. For example, it has been found that when kerosene is burned by the emulsion combustion method and exhaust gas recirculation method in combination therewith to operate the above-mentioned 6-ton boiler at the rated output, the nitrogen oxide emissions can be reduced to a level as low as 22 p.p.m., namely to about one fourth the concentration of nitrogen oxides resulting from burning of kerosene alone.

In view of the fact that these combustion methods achieve merely about 50% reduction in nitrogen oxide emissions when employed singly, it is entirely inconceivable that the combination of both methods attain such a remarkable reduction of nitrogen oxide emissions. In fact nothing whatever has been reported as to a combustion method which is capable of controlling nitrogen oxides to such a low concentration.

According to this invention, oils which are liquid at room temperature, immiscible with water and flammable are used for combustion. Examples are gasoline, kerosene, gas oil, fuel oil, naphtha, benzene, toluene, process oil, spindle oil, machine oil, lubricating oil and like mineral oils; fish oil, whale oil, linseed oil, sesame oil, soybean oil, castor oil and like animal and vegetable oils, etc. The fuel oil herein used is classified into three types as follows according to JIS K 2205-1960 and all types are usable for the present invention.

| Type of fuel oil | Flash point (°C) | Kinematic viscosity (st.) |
|---|---|---|
| Fuel oil — A | >60 | <20 |
| Fuel oil — B | >60 | <50 |
| Fuel oil — C | >70 | 50 – 400 |

Among these oils preferable are those which contain substantially no nitrogen-containing constituents, namely those containing such constituents in an amount of less than 0.1% by weight in terms of nitrogen, if any, based on oil. Examples are gasoline, kerosene, gas oil, fuel oil-A, naphtha, process oil, spindle oil, machine oil and lubricating oil. These oils are used singly, or at least two of them are used in admixture.

For the preparation of emulsion oil according to this invention, water is added to oil in an amount effective in reducing nitrogen oxides without entailing a great heat loss due to the evaporation of water. The ratio by volume of oil to water is usually 5 – 9 : 5 – 1, more preferably 7 – 8.5 : 3 – 1.5. The ratio of less than 5 : 5 involves difficulties in effecting continuous burning, entailing a great heat loss due to the evaporation of water. When the ratio is more than 9 : 1, the reduction rate of the nitrogen oxide emissions is limited to a maximum of 20%.

To improve the ignitability of the emulsion oil to be prepared, the water to be added to oil may be partially replaced by aliphatic alcohol having 1 to three carbon atoms such as methanol, ethanol, propanol, ethylene glycol or glycerin. Among these alcohols preferable are methanol, ethanol and propanol. These alcohols are used singly, or at least two of them are usable in admixture. It is generally suitable to use up to 10%, preferably 0.01 to 3%, of alcohol based on the volume of water from the viewpoint of cost.

When desired to prepare the emulsion oil with ease, a surfactant may be added to the ingredients. Usable as the surfactant is any of anionic, cationic and nonionic surfactants, among which nonionic surfactants which consist of carbon, hydrogen and oxygen atoms are preferable. The amount of surfactant to be used is generally 0.01 to 5% by volume based on emulsion oil to achieve good results. To stabilize the emulsion, the emulsion oil may further contain a stabilizer such as polyvinyl alcohol, carboxymethyl cellulose, sodium alginate or the like. The amount of the stabilizer to be used is usually 0.1 to 5% by volume, preferably 0.1 to 1% by volume, based on water.

The emulsion oil is prepared in a conventional manner. It can be prepared, for example, by mixing oil and water. Surfactant and/or emulsion stabilizer, when used, are preferably dissolved in water or oil before mixing.

Whether the emulsion oil obtained is of the oil-in-water type or of the water-in-oil type depends on the kind of surfactant, the ratio of oil to water, stirring method, etc. Both types of emulsion oils can be used according to this invention. The sizes of the particles suspended in the emulsion are preferably 0.1 to 50$\mu$, more preferably 0.1 to 20$\mu$. The viscosity of the emulsion is usually not higher than 5000 cps./60°C, preferably up to 500 cps./60°C.

According to the present invention it is essential to burn the emulsion oil while recycling a part of the resulting combustion exhaust gas to a combustion chamber. For this purpose, it is usually preferable to recycle 10 to 40% by volume, more desirably 20 to 30% by volume of the exhaust gas. When exhaust gas is recycled in the amount of less than 10% by volume, effective reduction of the nitrogen oxide emissions is not available. The recycling amount of exhaust gas in excess of 40% by volume fails to achieve efficient combustion and needs an enlarged combustion chamber.

When burning the emulsion oil by exhaust gas recirculation method, the emulsion oil is burned as it is diffused or atomized. Combustion air is usually used in an excess air coefficient (ratio of the quantity of comb stion air used to the quantity of combustion air theoretically required) of 1.0 to 3.0, preferably of 1.1 to 2.0. For atomization, any of steam, air, pressure, etc. is usable. With steam atomizing method, steam is usually employed in an amount of 2 to 50 weight %, preferably 5 to 30 weight %, based on the volume of oil to be burned and with air atomizing method air is generally applied at a pressure of 0.1 to 20 kg/cm$^2$ gauge, preferably 1 to 8 kg/cm$^2$ gauge. Pressure atomizing method can be usually conducted at a pressure of 0.01 to 100 kg/cm$^2$ gauge, preferably 1 to 50 kg/cm$^2$ gauge.

Figure 2:
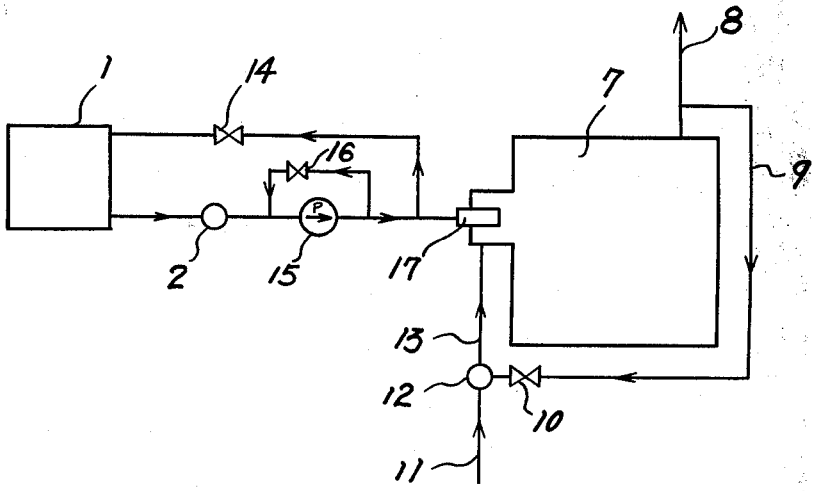

The method of this invention will be described below in greater detail with reference to the accompanying drawings in which:

FIG. 1 is a flow chart schematically showing steam (or air) atomizing combustion method using a boiler, employed as a preferred mode of practicing this invention; and FIG. 2 is a flow chart schematically showing pressure atomizing combustion method using a boiler, employed as another preferred mode of practicing this invention.

According to FIG. 1, the emulsion oil placed in a storage tank 1 is passed through a strainer 2 to remove solid such as dust therefrom and then forced into an atomizer nozzle 5 by a gear pump 3. The nozzle has a double construction. The emulsion oil is forced through the outer tube of the nozzle, while the steam supplied by way of an atomizing steam pipe 6 is passed through the inner tube of the nozzle at the same time and is jetted out into a combustion chamber 7 of a boiler. The jet of the steam drives the emulsion oil into the combustion chamber in atomized state for combustion. The flow rate of emulsion oil is adjusted by release valve 4 and the amount of steam to be used is controlled in corresponding relation to the flow rate of the emulsion oil by a suitable means (not shown). The exhaust gas resulting from combustion is discharged from exhaust gas outlet 8 and part of it is guided through an exhaust gas recycling line 9 and returned to the combustion chamber 7 by a fan 12. Fresh air admitted through a line 11 is mixed with the exhaust gas from the line 9, and the mixture, namely combustion air, is introduced into the combustion chamber 7 by way of a line 13. The amount of exhaust gas to be recycled is regulated by an exhaust gas control valve 10. If air is used in place of steam, the emulsion oil will be atomized by the air and then burned.

According to FIG. 2 the emulsion oil is burned in the same manner as in FIG. 1 except that the emulsion oil is atomized by pressure. The pressure is applied by a pump 15 and controlled by a release valve 14. Valve 16 serves as a relief valve. Nozzle 17 has a construction to atomize the emulsion oil by pressure unlike the steam atomizing nozzle 5 in FIG. 1. The same parts as used in FIG. 1 are indicated by the same reference numerals.

The combustion method of this invention assures a remarkable reduction in nitrogen oxide emissions without entailing formation of soot. The present method also has the advantage of being applicable to the incineration of waste oil or like flammable oily refuse when such refuse is used as oil.

Examples of this invention are given below in which parts are all by volume. The nitrogen oxide concentration of the exhaust gas is determined by constant-potential electrolysis method. In each example oil is burned using combustion air in excess air coefficient of about 1.2.

EXAMPLE 1

In 100 parts of kerosene is uniformly dissolved 0.2 part of nonionic surfactant (sorbitan monooleate). The kerosene and water are fed to a mixer continuously in a ratio of 80 parts of kerosene to 20 parts of water to prepare an emulsion oil of the water-in-oil type.

The emulsion oil continuously prepared as above is burned in a 6-ton boiler of the steam-atomizing type equipped with an exhaust gas recirculation system as shown in FIG. 1. Atomizing steam is supplied at a rate of about 50 kg/hr. According to the present method a marked reduction can be achieved in nitrogen oxide emissions as compared with conventional methods as listed in Table 1 below.

Table 1

| Oil | Combustion method* | Amount of oil (l/hr.) | Oxygen concn. of exhaust (vol.%) | Concn. of $NO_x$**(p.p.m.) |
|---|---|---|---|---|
| Kerosene | Usual | 500 | 3 – 5 | 79 – 82 |
| " | EGR | " | " | 35 – 42 |
| Emulsion | Usual | " | " | 34 – 37 |
| " | EGR | " | " | 20 – 25 |

Note:
*Usual: Usual combustion of oil without recycling exhaust gas.
EGR: Exhaust gas recirculation method in which 25% by volume of exhaust gas is recycled.
**$NO_x$: Nitrogen oxide emissions.

EXAMPLE 2

In 100 parts of fuel oil - A is uniformly dissolved 0.2 part of nonionic surfactant (sorbitan monooleate). The fuel oil and water are continuously fed to a mixer in a ratio of 80 parts of fuel oil to 20 parts of water to prepare an emulsion oil of the water-in-oil type. The emulsion oil thus prepared is burned in a 6-ton boiler of the steam-atomizing type equipped with an exhaust gas recirculation system as shown in FIG. 1, with the boiler operated under varying loads. Atomizing steam is supplied at a rate of 15, 35 and 50 kg/hr proportionally depending on the loads on boiler. As a result, nitrogen oxide emissions ($NO_x$) are found to be at greatly reduced levels as compared with conventional methods as given in Table 2 below.

Table 2

| Oil | Combustion method* | Oxygen concn. of exhaust gas (vol.%) | Concn. of $NO_x$ (p.p.m.) (load on boiler) 2 t/hr. | 4 t/hr. | 6 t/hr. |
|---|---|---|---|---|---|
| Fuel oil—A | Usual | 3 – 5 | 95 – 97 | 105 –107 | 113–117 |
| Emulsion | Usual | " | 48 – 52 | 53 – 56 | 55–58 |
| Emulsion | EGR | " | 34 – 38 | 37 – 39 | 39–43 |

Note:
*Usual: Same as in Table 1.
EGR: Practiced by recycling 20% by volume of exhaust gas.

EXAMPLE 3

In 100 parts of water is uniformly dissolved 2 parts of nonionic surfactant (polyoxyethylene lauryl ether, HLB: 17). The aqueous solution obtained and fuel oil-A are continuously fed to a mixer in a ratio of 30 : 70 by volume to prepare an emulsion oil of the oil-in-water type. The emulsion oil thus prepared is burned in a 6-ton boiler of the pressure-atomizing type equipped with an exhaust gas recirculation system. The oil is atomized at a rate of 300 l/hr. at an atomizing pressure of 12 kg/cm² gauge and at a rate of 500 l/hr. at an atomizing pressure of 35 kg/cm² gauge. Nitrogen oxide emissions ($NO_x$) are found to be at greatly reduced levels as compared with conventional methods as shown in Table 3 below.

Table 3

| Oil | Combustion method* | Oxygen concn. of exhaust gas (vol.%) | Concn. of $NO_x$ (p.p.m.) (Oil supply) 300 l/hr. | 500 l/hr. |
|---|---|---|---|---|
| Fuel oil—A | Usual | 3 – 5 | 85 – 90 | 110 – 115 |
| Emulsion | Usual | " | 58 – 63 | 78 – 85 |
| Emulsion | EGR | " | 35 – 40 | 50 – 55 |

Note:
*Usual and EGR: Same as in Table 2.

EXAMPLE 4

In the same manner as in Example 2, various emulsion oils of the water-in-oil type are prepared from fuel oil-A as listed in Table 4. The emulsion oils are burned in a 6-ton boiler of the pressure-atomizing type equipped with an exhaust gas recirculation system, while atomizing the oil at a pressure of 35 kg/cm² gauge. The resulting nitrogen oxide emissions ($NO_x$) are found to be at greatly reduced levels as compared with conventional methods as given in Table 4 below.

Table 4

| Fuel oil -A/ water | Oil | Combustion method* | Supply of oil (l/hr.) | Oxygen concn. of exhaust gas (vol.%) | Concn. of $NO_x$ (p.p.m.) |
|---|---|---|---|---|---|
| 100/0 | Fuel oil-A | Usual | 500 | 3 – 5 | 115 |

Table 4-continued

| Fuel oil -A/ water | Oil | Combustion method* | Supply of oil (l/hr.) | Oxygen concn. of exhaust gas (vol.%) | Concn. of $NO_x$ (p.p.m.) |
|---|---|---|---|---|---|
| 90/10 | Emulsion | Usual | " | " | 85 – 90 |
| " | " | EGR | " | " | 55 – 60 |
| 60/40 | " | Usual | " | " | 60 – 65 |
| " | " | EGR | " | " | 40 – 45 |

Note:
*Usual and EGR: Same as in Table 2.

EXAMPLE 5

In 100 parts of gas oil is uniformly dissolved 0.2 part of nonionic surfactant (sorbitan monooleate). The gas oil and aqueous methanol solution are mixed in the proportions as listed in Table 5 to prepare emulsion oils of the water-in-oil type. The emulsion oils are burned using a commercial diesel engine (Displacement: 2,200 cc, indirect injection type) equipped with an exhaust gas recirculation system and operated at 2,000 r.p.m. under no load. The ignitability of the emulsion oil is remarkably improved and the resulting hydrocarbon concentrations in exhaust gas are found to be at greatly reduced levels as given in Table 5 below.

Table 5

| No. | Components of emulsion oil (vol.%) Gas oil | Water | Methanol | Combustion method* | Concn. of $NO_x$ (p.p.m.) | Concn. of hydrocarbon (p.p.m.) |
|---|---|---|---|---|---|---|
| 1 | 83 | 30 | 0 | Usual | 80 – 90 | 400–420 |
| 2 | 83 | 30 | 0 | EGR | 40 – 50 | 200–250 |
| 3 | 83 | 30 | 0.03 | Usual | 70 – 80 | 80–90 |
| 4 | 83 | 30 | 0.03 | EGR | 40 – 50 | 40–70 |
| 5 | 83 | 29.7 | 0.3 | Usual | 70 – 80 | 80–90 |
| 6 | 83 | 29.7 | 0.3 | EGR | 40 – 50 | 40–70 |
| 7 | 83 | 27 | 3 | Usual | 80 – 95 | 70–80 |
| 8 | 83 | 27 | 3 | EGR | 40 – 55 | 40–60 |

Note:
*Usual and EGR: Same as in Table 2.

What we claim is:

1. In burning an emulsion oil containing oil and water in a ratio of 5 – 9 : 5 – 1 by volume, a method characterized in that the emulsion oil is burned while recycling 10 to 40% by volume of the resulting combustion exhaust gas to a combustion chamber.

2. The method as set forth in claim 1 wherein said oil contains substantially no nitrogencontaining constituents.

3. The method as set forth in claim 1 wherein the water contained in the emulsion oil is replaced by at least one aliphatic alcohol having one to three carbon atoms in the range of up to 10% by volume based on the water.

4. The method as set forth in claim 3 wherein said aliphatic alcohol is at least one of methanol, ethanol and propanol.

5. The method as set forth in claim 3 wherein the amount of alcohol is in the range of 0.01 to 3% by volume based on the water contained in the emulsion oil.

6. The method as set forth in claim 1 wherein said emulsion oil contains a surfactant in the range of 0.01 to 5% by volume based on the emulsion oil.

7. The method as set forth in claim 6 wherein said surfactant consists of carbon, hydrogen and oxygen atoms.

* * * * *

UNITED STATES PATENT OFFICE

CERTIFICATE OF CORRECTION

Patent No. 3,934,969 Dated January 27, 1976

Inventor(s) Hideyo Noda et al.

It is certified that error appears in the above-identified patent and that said Letters Patent are hereby corrected as shown below:

The "Assignee" of the patent should read:

--Toyo Rubber Industry Co., Ltd., Osaka-shi, Japan, and Kawasaki Jukogyo Kabushiki Kaisha, Kobe-shi, Japan--

Signed and Sealed this

*twenty-second* Day of *June 1976*

[SEAL]

*Attest:*

RUTH C. MASON
*Attesting Officer*

C. MARSHALL DANN
*Commissioner of Patents and Trademarks*